US008763546B2

(12) United States Patent
Brizzolara

(10) Patent No.: US 8,763,546 B2
(45) Date of Patent: Jul. 1, 2014

(54) WATERCRAFT DEVICE

(76) Inventor: Stefano Brizzolara, Genoa (IT)

( * ) Notice: Subject to any disclaimer, the term of this patent is extended or adjusted under 35 U.S.C. 154(b) by 179 days.

(21) Appl. No.: 13/361,512

(22) Filed: Jan. 30, 2012

(65) Prior Publication Data

US 2012/0192777 A1 Aug. 2, 2012

(30) Foreign Application Priority Data

Feb. 1, 2011 (IT) ..... GE2011A0011

(51) Int. Cl.
*B63B 1/00* (2006.01)

(52) U.S. Cl.
USPC ..... 114/61.14; 114/61.16; 114/61.2

(58) Field of Classification Search
USPC ..... 114/61.14, 61.16, 61.2
See application file for complete search history.

(56) References Cited

U.S. PATENT DOCUMENTS

| | | | | | |
|---|---|---|---|---|---|
| 3,541,987 | A | * | 11/1970 | Barkley | 114/61.16 |
| 4,174,671 | A | | 11/1979 | Seidl | |
| 4,944,238 | A | * | 7/1990 | Lang | 114/61.14 |
| 5,237,947 | A | | 8/1993 | Manning | |
| 5,313,906 | A | | 5/1994 | Zapka | |

FOREIGN PATENT DOCUMENTS

| | | |
|---|---|---|
| FR | 1449349 | 3/1966 |
| WO | 2007135486 | 11/2007 |

* cited by examiner

*Primary Examiner* — Stephen Avila
(74) *Attorney, Agent, or Firm* — Themis Law

(57) ABSTRACT

A watercraft device includes a central body and of two lateral hulls. Each lateral hull is connected to a central body by at least one connecting arm, so that the central body is in a raised position relative to two lateral hulls, the connecting arms having a given inclination to the vertical plane of the watercraft device. The two lateral arms and the central body are oriented with their longitudinal axes, i.e. the bow to stern axes, parallel to each other. Each of the two lateral hulls includes a body having a substantially cylindrical symmetry, with an annular constriction between the fore and the aft main sections of the lateral hulls.

16 Claims, 8 Drawing Sheets

WATERCRAFT DEVICE

FIELD OF THE INVENTION

The present invention relates to a watercraft device, which includes a central body and two lateral hulls. Each lateral hull is connected to a central body by at least one connecting arm, so that the central body is in a raised position relative to the two lateral hulls, the connecting arms having a given inclination relative to the vertical plane of the watercraft device.

Moreover, the two lateral arms and the central body are oriented to have their longitudinal axes, i.e. the fore-and-aft axes, parallel to each other.

Each connecting arm is made of a higher part connected to the central body and by another lower part connected to the lateral hulls, such that the second part is always underwater during navigation.

In particular, during navigation a watercraft device according to the present invention has an emerged part and a submerged part. The emerged part includes the central body together with the higher part of the connecting arms, while the submerged part includes the lateral arms together with the lower part of the connecting arms.

BACKGROUND OF THE INVENTION

The above description represents the typical configuration of a watercraft device known as "SWATH", an acronym of "Small Waterplane Area Twin Hull."

These vessels are made of a watercraft that generally has two lateral hulls, representing the above mentioned Twin Hulls, which are submerged below the free surface so that the waterline figure is reduced. This area reduction allows reducing the motions and sustaining speed in waves of the SWATH for a given power, inasmuch as the variation of displaced volume by the total SWATH due to an incoming wave is also reduced.

The SWATH device of this patent has been studied to be particularly used as an autonomous surface vehicle, to perform offshore environment measurements and monitoring, as well as to launch recovery and maintenance of underwater devices (generally autonomous also), those underwater devices being also used for monitoring seabed and water conditions or other kind of missions, as for example, mine detection.

Unlike conventional catamarans, in SWATH devices, during navigation, lateral hulls are completely maintained below the water surface, so that they are less influenced by wave actions, because the force exerted by the waves on submerged structures decreases exponentially with increasing depth.

Therefore, the shift of both hulls below sea level gives SWATH devices a better seakeeping in sea waves than conventional devices and catamarans. This is why SWATH devices are particularly suited for use in offshore operations, either manned or unmanned, as autonomous vehicles.

Despite high stability in sea waves provided by the above described configuration, SWATH devices have the disadvantage of higher propulsion powering requirements, especially at high speeds and hence have higher fuel consumptions. In fact, compared to equivalent mono-hulls or catamarans, these devices experience more drag when moving at a given speed in calm water or, conversely, with a given propulsion power they reach a lower speed. This is due to the higher wetted surface of the SWATH watercraft and to its higher wave resistance (related to the wave formation generated by the hull advancing at steady speed in calm water) of the submerged hulls, if these hulls have conventional (traditional) shape, that is, a shape not properly modeled according to the present invention.

Therefore, there is an unmet need to realize a floating device, which can operate without personnel on board, preferably of a SWATH type; which can reach a high platform stability in relatively high sea states with simple and inexpensive devices; and which at the same time can reach higher speeds than the state of the art SWATH devices, ensuring a low fuel consumption that is at least comparable if not lower than the traditional hulls of equivalent size and capacity.

SUMMARY OF THE INVENTION

The present invention achieves the above purposes by providing a floating device as previously described, in which each of the two side hulls has a substantially cylindrical symmetry that includes an annular constriction at a transverse section in an intermediate longitudinal position between the bow and the stern of the lateral hulls.

The shrinkage is an annular constriction, that is, on each of the side hulls at the shrinkage position, shows a reduction in radial dimensions with respect to its longitudinal axis.

Each of the two lateral hulls includes a long and thin body, which has a substantially cylindrical symmetry, and which presents an annular constriction of the intermediate section, with area changes between 5% and 80% of the maximum area section, in a longitudinal appropriate position between the main (maximum area) sections of the forward and aft portions of the side hulls.

The amount of the reduction of the intermediate section and the position of the contracted section as well as of the other two sections with maximum area, in the fore and aft part of the side hulls is function of the vessel's speed, of the length of the side hulls and of the position of the connecting arms. The values of the above geometric parameters corresponding to the minimum drag of the hulls are determined by using automatic computational procedures (computer based) specifically developed and based on a parametric definition of the hulls' shape, on multi-objectives constrained optimization algorithms and numerical hydrodynamic methods for the estimation of the wave pattern and wave resistance of a given multihull form.

So the profile of the hulls is changed in order to reduce its drag, maintaining the good stability in rough seas and at the same time to decrease the resistance force that the waves exert on the hull, so increasing the maximum speed of the vessel and keeping consumption under control.

In this way the resistance to the motion of advance can be reduced when the speed increases, compared to the known state of the art of similar watercrafts.

As more detailed in the following descriptions of some execution examples of the watercraft device, subject of the present invention, each of the two side hulls opportunely includes a body inscribed inside a cylinder, the central portion of which presents an annular constriction and whose entrance and outer portions include a lobe-shaped element.

According to an improvement, the two lateral hulls provide four lobe-shaped elements, each of which has a transverse axis (in the horizontal plane) whose length is larger than the transverse axis (in the vertical plane), so that each lateral hull comes with a flattened and symmetric shape with respect to a vertical or horizontal axis passing through the center of the cylinder, inside which it is possible to inscribe the shape of the two lateral hulls The following experimental data show how favorable it is to adopt the lateral hulls profiles above described, being particularly effective in the reducing of forces due to the waves on the hull wetted surface.

In particular, to allow such a flattened shape, the annular constriction has a substantially elliptical section, preferably with the major axis of the ellipse oriented parallel and/or coincident with the transverse axis in the horizontal plane of the two side hulls and the minor axis of the ellipse oriented parallel and/or coincident with the vertical axis of the two lateral hulls.

Preferably the ring is provided in a central location of the cylindrical symmetry body of the two side hulls, properly identified by means of numerical simulation of the flow and shape optimization.

As provided for SWATHs, the device object of the present invention is preferably formed by a part above the water surface which includes a central body and the emerged portion of the connecting arms, and by another submerged part, which includes the submerged (lower) portion of the connecting arms and the two side hulls.

A ballast system can be advantageously provided, and it should even the distribution of the weight over the entire length of the watercraft device, particularly along the volume of the side hulls. This system can be arranged inside the side hulls and results to be particularly useful to ensure a high stability in waves of the whole watercraft device.

In fact, a considerable portion of the total weight of the device is made up by the fuel, which obviously decreases during navigation. So the advantage of providing systems that compensate for the weight loss of the fuel, embarking an amount of water corresponding to the weight of consumed fuel inside ballast tanks arranged in the side hulls.

According to a preferred form of implementation, the watercraft device subject of the present invention provides for each side hull two arms, connected to a central body, that are located upstream and downstream of the constricted section. As will be evident from the figures and from experimental studies carried out, such a structure allows increasing the form stability (both transverse and longitudinal) of the whole vessel and also allows configuring the watercraft device according to different forms of implementation.

In fact, it is particularly advantageous the possibility of varying inclinations of the various connecting arms, also depending on the sea state encountered during operation. In particular, the inclination of the arms can be variable both with respect to the horizontal plane and to the vertical plane of the device vessel.

This feature is particularly important because one of the factors affecting the hydrostatic stability of SWATH devices is the distance between the center of mass of the device and the pro-metacentre. As later explained, the weight of the device varies, both due to the decrease of fuel and as a consequence of the underwater vehicles recovery operations: this weight change causes a change in the vertical position of the center of mass and the possibility of varying the inclination of the connecting arms maximizes the distance between the center of buoyancy and the center of mass, in order to improve the stability of the device vessel.

To achieve this, each one of the connecting arms is connected to the central body through a coupling that allows the degrees of freedom necessary to adjust the inclination of the arm with respect both to the horizontal plane and to the vertical plane of the watercraft device.

After adjusting the inclination of each arm, to secure the configuration chosen a stiffening element for each of the connecting arms is preferably provided, in such as way to limit and/or eliminate the relative motion between each connecting arm and the central body.

Each stiffening element has a tubular element with a first end connected to the central body and a second end connected to the mid position of the emerged portion of the connecting arm.

Advantageously, it is foreseen that the tubular element is adjustable and lockable under varying conditions of length.

In one embodiment, this element consists of a telescopic body to allow, through the adjustment of its length, a further adjustment of the inclination angle of the connecting arms. The elongation and/or shortening of the telescopic element can be done either manually or automatically, e.g. by electric motors and/or hydraulic or pneumatic actuators.

The ability to adjust the inclination of the connecting arms also allows a regulation of the tilting angle in relation to the different types of connecting arms.

For example, it is possible to provide that the connecting arm upstream of the annular constriction showing a diverging direction towards the two side hulls, while the two arms positioned aft of the annular constriction have a direction converging to those two side hulls, or vice versa. Obviously the shape of the central body will adjust accordingly, for instance presenting a larger breadth at the extremities that are converging on the two lateral hulls.

The different inclination (eventually opposite) of the forward connecting arms with respect to the aft ones can help in decreasing the resistance of the whole device, as the waves created by the first pair of arms do not affect, i.e. they do not impinge into the second pair, thus decreasing the action created by the wave motion on the emerged part of the device vessel.

In one embodiment, connecting arms can be provided as detachable from the main body, a feature that is advantageous both for maintenance and repairs of the device craft, and to reduce the size in the case of storage in dedicated facilities.

In another embodiment, in order to further reduce the motion of the whole device in waves, each lateral hull can be provided with at least one active fin stabilizer that extends from the outer surface of each of the two side hulls in a direction substantially parallel to the horizontal plane of the device.

The present invention relates to regards a watercraft device that includes a central body and two lateral hulls, in which each side hull is connected to the central body by at least one connecting arm, so that the central body is in a raised position relative to two lateral hulls. The connecting arms have a given inclination to the vertical plane of the watercraft device, and the two lateral arms and the central body are oriented with their longitudinal axis, i.e. the fore-and-aft axes, parallel to each other. Each connecting arm is may be dismountable from the main body, and the total dimensions of the device are such that it may be to put it in disassembled state inside standardized container sizes.

The above described removable device is provided in combination with one and/or all of the features described so far and below.

The invention also relates to other features that further improve the above described watercraft device and that are recited in the appended claims.

BRIEF DESCRIPTION OF THE DRAWINGS

These and other features and advantages of the present invention will be more clear from the following description of some executive examples illustrated in the attached drawings in which:

FIGS. 2*a* through 2*f* illustrate a particular embodiment of the lateral hull belonging to the device subject of the present invention; wherein:

FIG. 2*a* shows a perspective view of a lateral hull according to an executive variant of the invention, in which the section of the lateral hulls with a transversal plane with respect to the longitudinal axis (bow-stern direction) is not cylindrical, but flattened in the direction of the vertical axis so as to present an oval section, in this particular execution elliptical;

FIG. 2*b* illustrates a perspective view of a lateral hull according to FIG. 2*a*, with the ends of the two connecting arms having a fusiform profile in the transversal section;

FIG. 2*c* is a view similar to FIG. 2*b*, where the lateral hull is rotated around its longitudinal axis so that the view point is approximately perpendicular to the connecting arms;

FIG. 2*d* is a view of the lateral hull and of the connecting arm in the direction of the longitudinal axis of the lateral hull;

FIG. 2*e* shows the profile of the lateral hull shown in previous figures obtained by intersections with a horizontal plane, and the parameterization of the same by using a B-spline curve with a control polygon having seven points, opportunely positioned to define the characteristic basic curve of the two-lobe-shaped lateral hulls;

FIG. 2*f* illustrates the form of a connecting arm in perspective view;

DETAILED DESCRIPTION OF EMBODIMENTS IF THE INVENTION

Figure 1A:
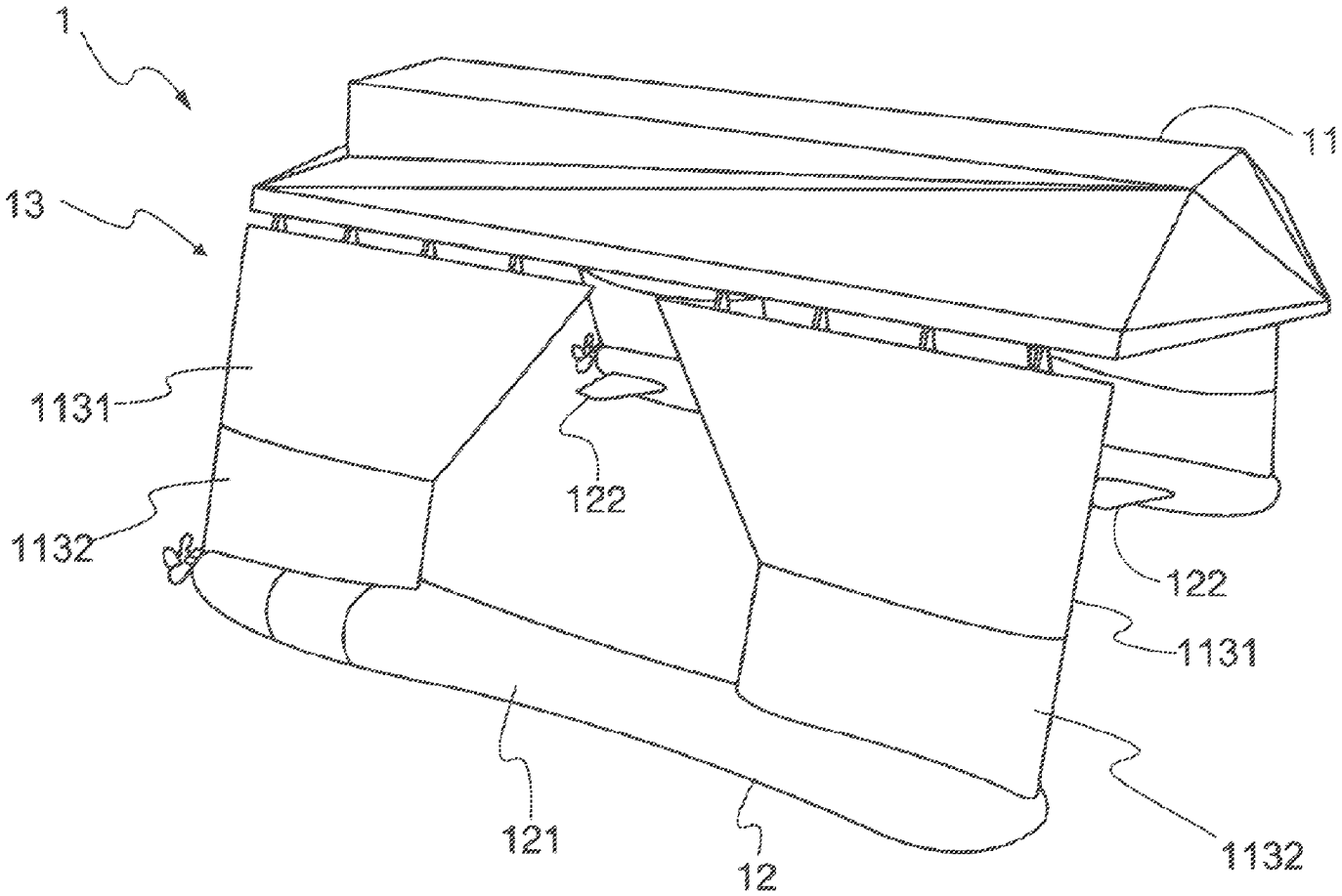
FIGS. 1*a* and 1*b* illustrate two views of the watercraft device subject of the present invention according to a first executive variant.
Figure 1B:
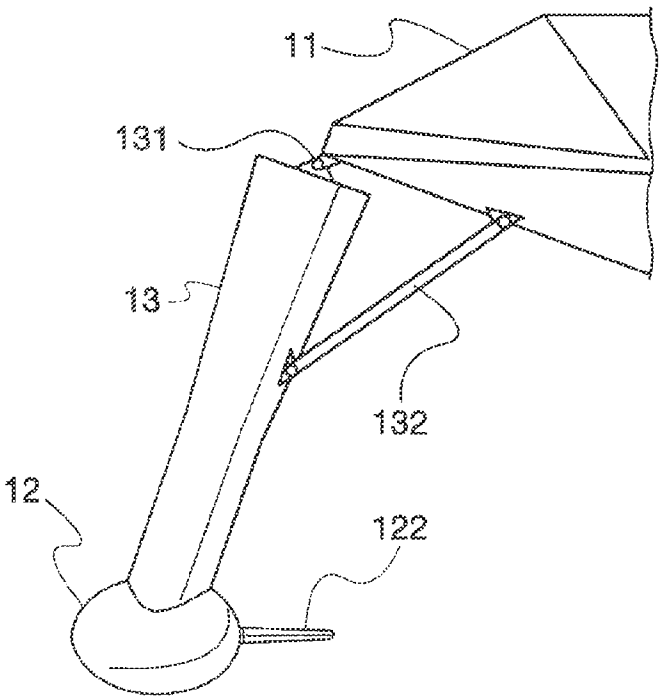

With particular reference to FIGS. 1*a* and 1*b*, a watercraft device 1 according to an embodiment of the present invention is made of a central body 11 and two lateral hulls 12.

Each lateral hull 12 is connected to the main body 1 through the connecting arm 13 in such a way that the central body 11 is in an elevated position with respect to the two lateral hulls 12, and this elevated position is guaranteed by a particular inclination of the connecting arm 13 to the vertical plane of the device vessel 1.

It is possible to provide only one connecting arm for each lateral hull, or two, three or more arms fort each lateral hull. The illustrated and preferred solution for this invention has two arms connected to each lateral hull.

Each one of the connecting arms 13 has a first top part 1131 connected to the central body 11 and a second bottom side 1132 connected to the hull 12, so that the second part 1132 is submerged during navigation.

In fact during navigation the watercraft device 1 is characterized by an emerged part and a submerged part: the main body 11 and the top part 1131 of the connecting arms 13 are emerged, while the lateral hulls 12 and the bottom 1132 of the connecting arms 13 are submerged.

The main body 11 is oriented with its longitudinal axis (bow-stern direction) parallel to the longitudinal axis (bow-stern) of the lateral hulls 12.

The main body 11 can consist of an element of any form, mainly to contain all the equipments necessary to enable the operations provided for the vessel. These can be very different for both civil and military purposes and a particular application is to use the vessel as an autonomous surface vehicle for monitoring sea conditions and for autonomous launching and recovery of underwater vehicles.

In a first variant, each one of the two lateral hulls 12 have a body with an essentially cylindrical symmetry and with an annular shrinking 121 in the area between the bow (123) and the stern (124) ends of the hull 12.

The watercraft device 1 is thus made up of an emerged part having the main body 11 and a submerged part that includes the two lateral hulls 12, while the connecting arms 13 appear to be partly underwater and partly emerged.

With particular reference to FIG. 1*a*, the connecting arms 13 are four, two on each side of the lateral hulls 12; two of them are located upstream of the constriction ring 121 and the other downstream of it.

With particular reference to FIG. 1*b*, the inclination of the connecting arms 13 is adjustable in order to vary the trim of the device 1, according to sea state conditions and to operating mode of the watercraft.

In the executive variant illustrated in FIGS. 1*a* and 1*b*, the inclination of the connecting arms is adjustable only in the vertical plane of the device 1, in order to raise and lower the central body 11.

It is however possible to provide for this inclination angle to be adjustable also in the horizontal plane of the device 1, or rather for the central body 11 to be movable back and forth over the side hulls 12. Alternatively it is possible for the connecting arms 13 to make a rotation, creating a convergent or divergent direction of the lateral hulls 12 with respect to the longitudinal axis of the watercraft device 1. These different possibilities of orientation of the connecting arms permit to obtain different configurations and relative positions of the lateral hulls with each other or with respect to the central body 11, and therefore they allow a vast flexibility to different operating conditions and purposes of use. These possibilities of reconfiguration of the vessel geometry may be provided all together or partially or singularly, as needed for use.

The adjustment of the inclination of the connecting arms 13 is permitted by a coupling interface 131 that connects one end of each connecting arm 13 to the central body 11 and allows the degrees of freedom provided. Such a coupling can also be provided for connecting the arm to the lateral hulls although this embodiment (not specifically illustrated).

In the particular case of FIG. 1*b*, one degree of freedom is presented, as necessary for adjusting the inclination of the connecting arms 13. In particular, the degree of freedom is that the arms are tiltable around an axis parallel to the longitudinal axis (from bow to stern) of the vessel, at least at the joint connecting the main body 11. If necessary, the arms can also be connected to the corresponding lateral hull by means of a joint that allows the rotation at least around an axis parallel to the longitudinal axis of the vessel.

Any of the joints can be built rigid, though automatically or manually adjustable, or flexible, featuring spring and damper elements, in order to realize, in this second case, a suspension system of the central body with respect to the lateral hulls.

FIG. 1*b* also shows a stiffening element 132 made of a tubular element with a first end connected to the central body 11 and a second end connected to each one of the connecting arms 13 at an intermediate position near the end of the connecting arm 13 towards the central body 11.

The presence of stiffening element 132 allows limiting and/or blocking the movement between the main body 11 and the connecting arms 13, once their inclination is set.

In addition to support the action of the joint interface 131 in the regulation of the inclination of the connecting arms 13, the stiffening element 132 may be formed by an elongated element, such as a strut or a rod telescopically extendable. The extension may be by manual or by mechanical devices, or suitable motorized devices. Locking devices for the stiffening element are provided, so that different inclination angles of the connecting arms 13 with respect to the central body 11 can be achieved.

According to another executive variant, the inclination of the connecting arms 13 is such that the two arms upstream of the annular constricted section 121 have a diverging direction towards the two lateral hulls 12, while the two connecting arms 13 downstream of the annular constricted section 121 have a convergent direction towards the two lateral hulls 12, or vice versa.

In this case, the central body 11 is wider near the ends of the connecting arms 13 converging towards the two lateral hulls 12; this is necessary to connect the arms, as the distance between the two ends of the connecting arms 13 converging to the central body 11 is greater than that between the two ends of the divergent connecting arms 13.

The enlargement can be made of two extension elements in the transverse direction of the central area of the body 11, near the ends of the converging connecting arms 13, or it can consist of an enlargement of the entire main body 11, whether it is a parallelepiped-shaped body or any form.

Furthermore, with particular reference to FIGS. 1*a* and 1*b*, the watercraft device 1 subject of this invention includes two stabilizer fins 122 for each lateral hull 12. The stabilizer fin 122 extends from the wall of each of two lateral hulls 12 in the direction substantially parallel to the horizontal plane of the device 1, so that the fin 122 extends from a lateral hull 12 towards the opposite lateral hull 12.

The stabilizer fins are intended to be fixed, adjustable at an angle relative to the horizontal plane; this is due to a rotation around a horizontal axis perpendicular to the longitudinal axis of the corresponding lateral hull, and/or with a rotation around an axis parallel to the longitudinal axis of the corresponding lateral hull; but these fins can also be active, i.e. each one moved by electric or hydraulic motors for its rotation around the axis of the engine, to control the dynamic trim and sinkage of the vehicle and dampen the vessel's motion in a sea state.

FIGS. 2*a* through 2*f* illustrate a particular executive embodiment of the lateral hull 12 belonging to the device 1 object of the present invention.

According to this embodiment, the lateral hull 12 includes a body inscribed inside a cylinder, which has an annular constriction 121 in its central portion and includes two lobe-shaped elements 123 and 124 at both ends.

Each lobe 123 and 124 has a transverse axis in the horizontal plane A, which has a length greater than the transverse axis in the vertical plane B, so as to give the two lobes 123 and 124 a flattened form.

Figure 2A:
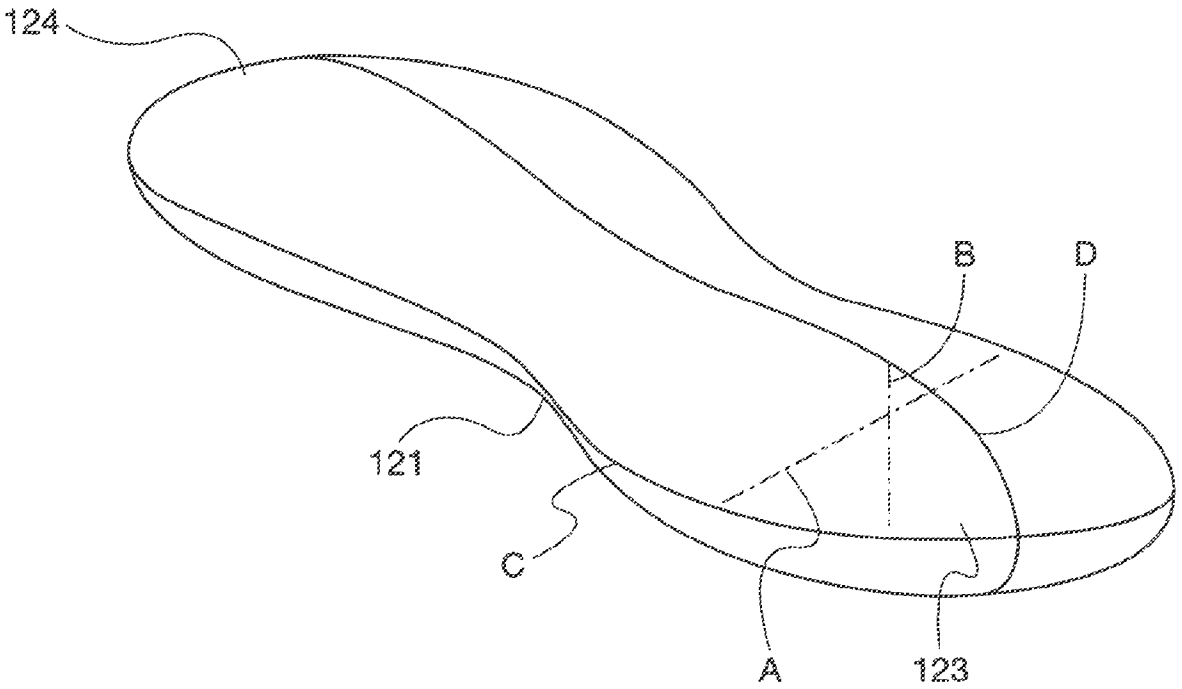
Figure 2D:
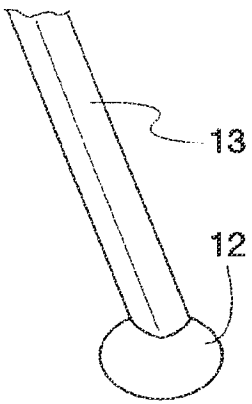
Figure 2B:
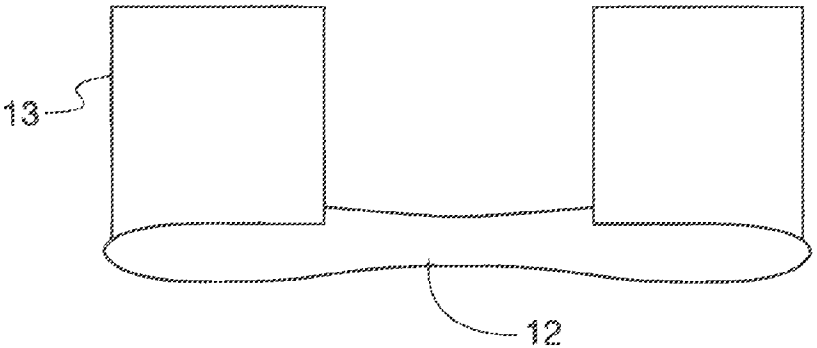
Figure 2C:
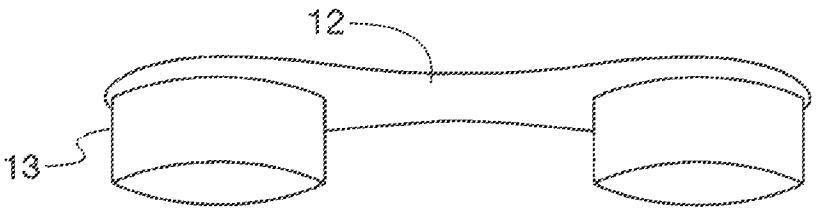

Consequently, the annular constriction 121 has an elliptical cross section and, with particular reference to FIG. 2*a*, the major axis of the elliptical cross section is oriented parallel and/or coincident to the transverse axis on the horizontal plane A of the lobe 123, while the minor axis is perpendicular to the axis A.

With particular reference to FIGS. 2*a* through 2*d*, the annular constriction 121 is provided in an intermediate portion between the fore and aft end of the lateral hulls 12, while the connecting arms 13 are placed close to the central area of the lobes 123 and 124.

In order to optimize the shape of the lobe elements 123 and 124 and the entire body of the lateral hull 12, according to the executive variant shown in the FIGS. 2*a* through 2*f*, a series of numerical simulations were carried out, using an automatic (computer based) optimization method, in order to obtain a hull shape 12 that would allow achieving the lowest resistance to the advance motion of the device 1 vessel, decreasing the resistance force to the advance motion of the hull, created by the action of the generated waves on the surface of the lateral hull 12, while maintaining high level of stability of the device 1.

In particular, this study has been made on the shape of the two profiles C and D, based on which it is possible due to symmetry conditions to develop the shape and volume of the entire lateral hull 12.

To carry out the study that led to the results shown in FIGS. 2*a* through 2*f*, a parametric model of the watercraft device geometry has been created using a CAD-type surface modeling routine, based on B-Surface definition.

Figure 2E:
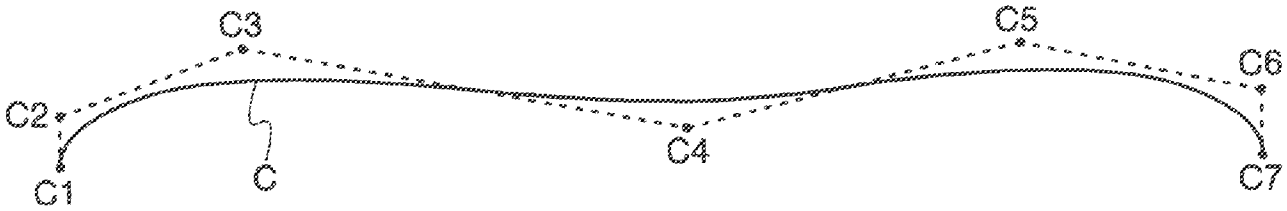

FIG. 2*e* shows in particular the study of the case for the profile C; the same procedure was then performed on profile D, which can alternatively be obtained by applying a multiplication factor to the results obtained for the profile C.

Profile C is parameterized through the use of seven control points C1, C2, C3, C4, C5, C6 and C7; the spatial coordinates of some of these points were taken as unknowns and processed by that software.

In particular:

point C1 corresponds to the origin of the axes of the reference system, all control points C1, C2, C3, C4, C5, C6 and C7 have the same y coordinate as they are all on the same plane, which coincides with the horizontal side of the hull 12, the abscissas of the points C1, C2, C6 and C7 are known, as the points C1 and C2 can be taken with an x coordinate equal to zero, while the points C6 and C7 can be taken with an x coordinate equal to zero and to the entire length of the lateral hull 12, respectively, the distance between C1 and C2 and between C6 and C7 regulates the radius at the leading edge of the parametric curve, coordinates z of the points C1 and C7 are also known and equal to zero.

The remaining coordinates are the free variables of the optimization procedure. They are the parameters whose values were calculated using experimental evidence to achieve the result shown in FIGS. 2*a* and 2*d*.

The annular constriction of the elliptical section 121 represented in FIGS. 2*a* to 2*d* is then calculated according to the length of the lateral hull 12 of the watercraft device 1, but has values between 10% and 80% of the larger diameter cross section of the hull 12, i.e. the elliptical section which presents as the major axis and minor axis respectively the A and B axes.

The calculation of the parameters is done in order to obtain a profile that most reduces the resistance to motion of the watercraft device 1.

Figure 2F:
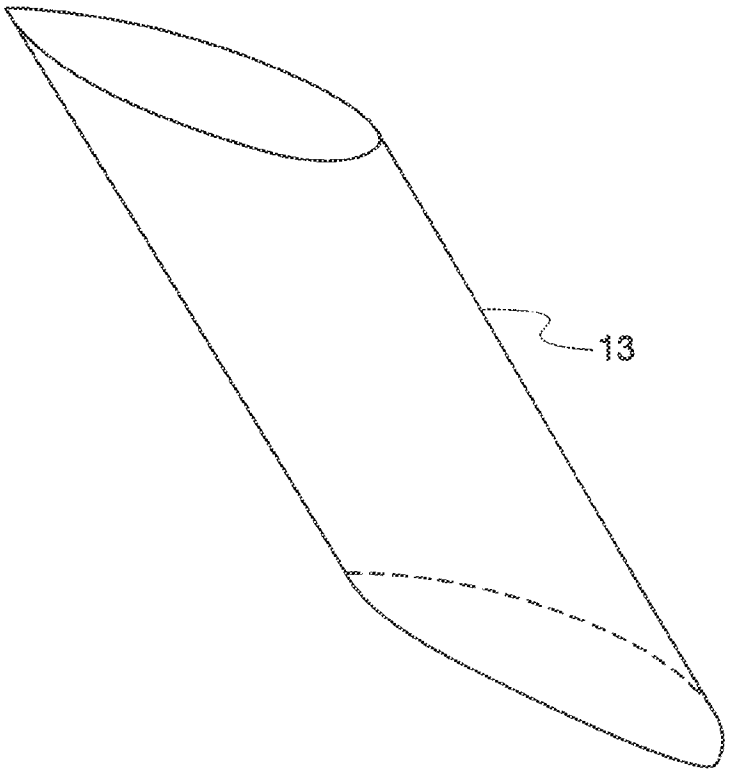

Also the connecting arms 13 have been created through a similar parametric optimization procedure and through the study of parameters that have been developed and compared with experimental data; the starting model of the connecting arm 13 consists, however, of a body that has a "wing" profile, shown in FIG. 2*f*, chosen for its good aerodynamic characteristics.

Figure 3:
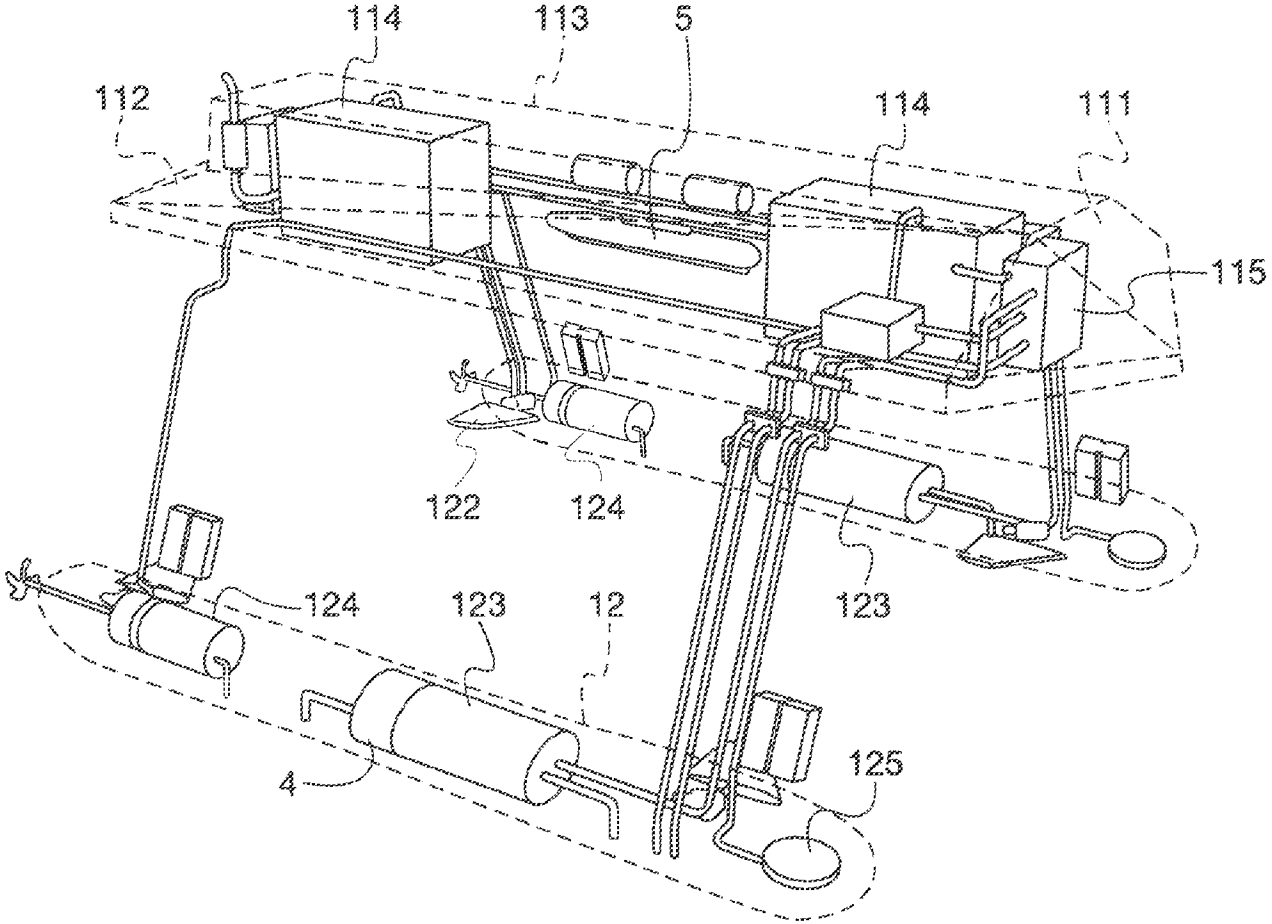
FIG. 3 illustrates the arrangement of the various internal systems or operating units provided in any execution of the variants described in the previous figures.

FIG. 3 illustrates one form of implementation of the device 1, subject of the present invention, with particular reference to the mechanical and electrical components and equipment mounted inside the device 1; this form of implementation may be provided in combination with the characteristics described above and relating to any of the variants according to the previous FIGS. 1*a* to 2*f*.

The main body 11 is divided into three sections (compartments) 111, 112 and 113; sections 111 and 112, respectively, at the bow and at the stern of the watercraft device 1, contain diesel generators 114, the variable frequency AC/DC/AC converters 115 for power supply to all the electrical systems onboard (including communication tools, necessary for navigation) and for adjusting the speed of the electric motors for propelling the vehicle, while the section 113 placed in a central position of the body 11, is designed to accommodate an underwater vehicle 5 that is recovered from the Watercraft device 1.

Inside the connecting arms 13 piping and electrical cables are arranged, so that the central body 11 is functionally connected with the lateral hulls 12. Inside the two lateral hulls 12 there are the fuel tanks 123, the electric motors 124 and the necessary tools 125 for autonomous navigation, such as obstacle detectors, and/or tools necessary for environmental measurement carried out by the watercraft vessel 1, during its missions.

Moreover inside the two lateral hulls 12, a sea water ballast system is provided, to compensate for the weight of the device 1, to be achieved with appropriate ballast tanks, specular to the fuel tanks, so that the weight of the vessel device 1 is substantially constant.

With particular reference to FIG. 3, this system includes two tanks 4 designed to compensate the weight loss caused by the fuel consumption during, which are fulfilled with a quantity of sea water corresponding to the weight of the consumed fuel.

Since even the recovery of underwater vehicles, heaved and hosted in the central section 113 of the central body 11, corresponds to a weight increase for the device 1, in the lateral hulls 12 additional tanks of ballast water are provided from which a quantity of ballast water corresponding to the weight of the underwater heaved vehicle 5 is pumped out.

Figure 4:
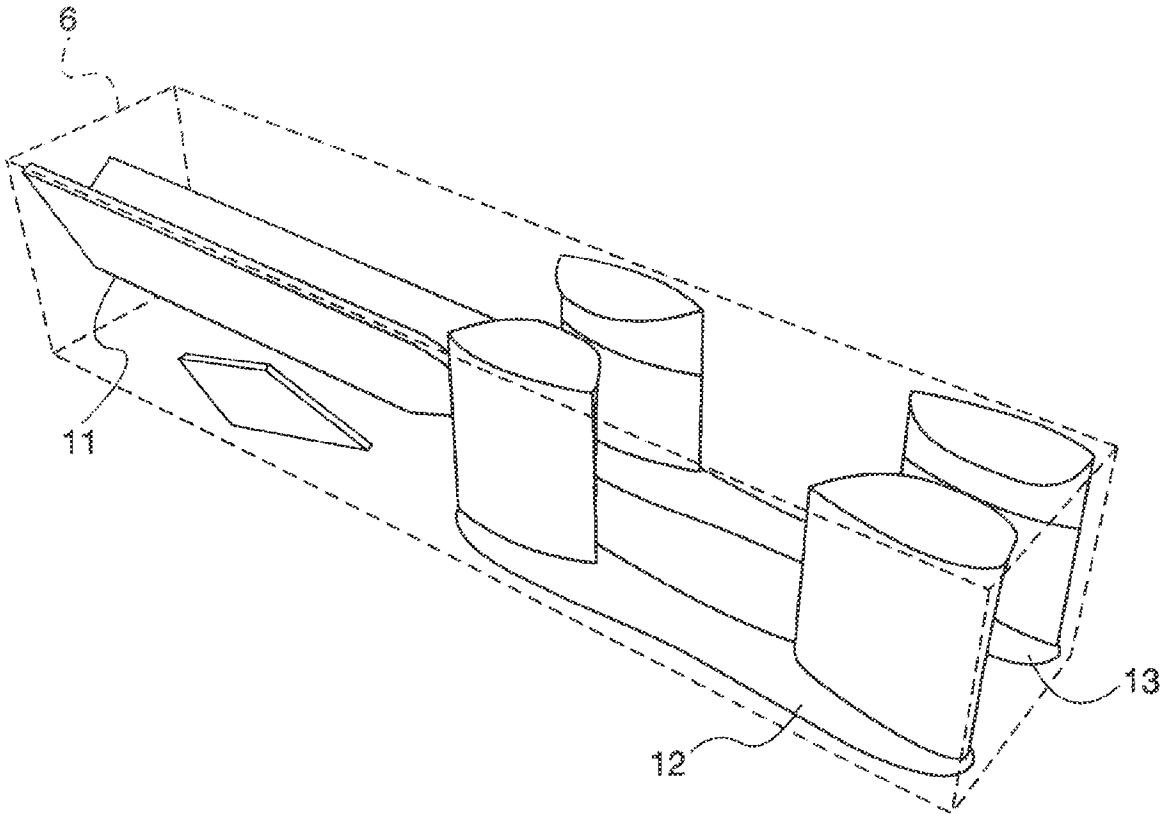
FIG. 4 illustrates the executive variant of the device according to the present invention, whereby the connecting arms are removable from the central part and from the side hulls in order to allow the transportation of the vessel disassembled into a container with given proportion and in particular those of a standard 40' container.

According to an executive variant, it is possible for the connecting arms 13 to be removable from the main body 11. FIG. 4 shows the executive variant, i.e. a device made of a main body 11 and two lateral hulls 12, each one of these two lateral hulls 12 connected to the main body 11 through at least two connecting arms 13, in such a way that the central body 11 stays in an elevated position with respect to the two lateral hulls 12, when the connecting arms 13 are mounted and have a certain inclination with respect to the vertical plane of the watercraft device.

Each one of the connecting arms 13 is dismountable from the main body 11, and the size of the entire device is such that it is possible to insert the connecting arms 13 still connected to the lateral hulls 12 but dismounted from the main body 11 inside a container 6 ISO 20 and/or ISO 40.

The invention claimed is:

1. A watercraft device comprising:

a central body;

two lateral hulls; and two or more connecting arms each connecting one of the two lateral hulls to the central body, such that the central body is in a raised position relative to the two lateral hulls, the two or more connecting arms having a given inclination relative to a vertical axis of the watercraft device, wherein the two lateral hulls and the central body have longitudinal axes parallel to each other, wherein the two or more connecting arms each comprise a first upper part connected to the central body and of a second lower part connected to one of the lateral hulls, such that the second part is submerged during navigation, and wherein each of the two lateral hulls comprises an elongated body having a substantially cylindrical symmetry, with an annular constriction defined between a fore portion disposed at a first longitudinal end of a lateral hull and an aft portion disposed at a second longitudinal end of the lateral hull, the fore and aft portions having widest cross-sections of the elongated body that taper to define the annular constriction therebetween.

2. The device as claimed in claim 1, wherein the elongated body has the annular construction in a center portion, a position of the annular constriction being determined by simulation of hydrodynamic flow around the two lateral hulls and by automatic parametric shape optimization as a function of speed, each of two ends of each of the two lateral hulls comprising a lobe member.

3. A watercraft device comprising:

a central body;

two lateral hulls; and two or more connecting arms each connecting one of the two lateral hulls to the central body, such that the central body is in a raised position relative to the two lateral hulls, the two or more connecting arms having a given inclination relative to a vertical axis of the watercraft device, wherein the two lateral hulls and the central body have longitudinal axes parallel to each other, wherein the two or more connecting arms each comprise a first upper part connected to the central body and of a second lower part connected to one of the lateral hulls, such that the second part is submerged during navigation, wherein each of the two lateral hulls comprises a body having a substantially cylindrical symmetry, with an annular constriction defined between fore and aft of the lateral hulls, the elongated body has the annular construction in a middle portion, a position of the annular constriction being determined by simulation of hydrodynamic flow around the two lateral hulls and by automatic parametric shape optimization as a function of speed, each of two ends of each of the two lateral hulls comprising a lobe member, and wherein each of the lobe members has a transverse axis on a horizontal plane that is longer than a transverse axis on the vertical plane.

4. The device as claimed in claim 1, wherein the annular constriction has a substantially cylindrical section, or is flattened along the vertical axis.

5. The device as claimed in claim 1, wherein the two lateral hulls are in such a position that the watercraft device has an emergent part comprising the central body and a submerged part comprising the two lateral hulls.

6. The device as claimed in claim 1, further comprising a weight balancing system in the two lateral hulls for balancing weight of the watercraft device, whereby the weight of the entire watercraft device remains substantially constant during navigation and operation.

7. The device as claimed in claim 1, wherein each of the two lateral hulls is connected to the central body through two of the connecting arms upstream and downstream from the annular constriction.

8. The watercraft device as claimed in claim 1, wherein the inclination of the two or more connecting arms relative to the central body is adjustable by pivoting each of the two or more connecting arms at least about one axis substantially parallel to the longitudinal axis of the watercraft.

9. The device as claimed in claim 1, wherein the at two or more connecting arms are structured to be pivoted about at least one additional axis tangent to the longitudinal axis.

10. The device as claimed in claim 1, wherein each of the two or more connecting arms is connected at one end to the central body with an interface joint allowing the connecting arm to pivot about an axis parallel to the longitudinal axis of the watercraft or to the central body.

11. The device as claimed in claim 1, wherein the each of the two or more connecting arms is connected at one end to one of the two lateral hulls and is rotatable about an axis parallel to an axis extending from the one of the two lateral hulls toward the central body, a connecting joint with pivotal degrees of freedom being provided between the connecting arm and the one of the two lateral hulls.

12. The device as claimed in claim 1, further comprising a stiffening member for each of the two or more connecting arms adapted to limit or prevent any relative motion between the connecting arm and the central body or a respective lateral hull, wherein the stiffening member comprises a strut having a first end connected to the central body and a second end connected to the connecting arm in an intermediate position near an end of the connecting arm.

13. The device as claimed in claim 12, wherein the stiffening member is adjustable in length in a manual or motorized manner and is configured to be locked at different lengths.

14. The device as claimed in claim 12, wherein the connecting arm or the stiffening member are removable at least from the central body or from a corresponding one of the two lateral hulls.

15. A watercraft device comprising:

a central body;

two lateral hulls; and two or more connecting arms each connecting one of the two lateral hulls to the central body, such that the central body is in a raised position relative to the two lateral hulls, the two or more connecting arms having a given inclination relative to a vertical axis of the watercraft device, wherein the two lateral hulls and the central body have longitudinal axes parallel to each other, wherein the two or more connecting arms each comprise a first upper part connected to the central body and of a second lower part connected to one of the lateral hulls, such that the second part is submerged during navigation, wherein each of the two lateral hulls comprises a body having a substantially cylindrical symmetry, with an annular constriction defined between fore and aft of the lateral hulls, wherein the two or more connecting arms comprise, two connecting arm disposed upstream from the annular constriction with in diverging directions relative to the two lateral hulls, and two connecting arms disposed downstream from the annular constriction with a direction converging toward the two lateral hulls, or vice versa, and wherein the central body has an enlargement at least near ends of the connecting arms disposed in the converging direction.

16. A watercraft device comprising:

a central body;

two lateral hulls; and two or more connecting arm each connecting one of the two lateral hulls to the central body, such that the central body is in a raised position relative to the two lateral hulls, the connecting arms having a given inclination to the vertical plane of the watercraft device, wherein the two lateral hulls and the central body have longitudinal axes parallel to each other, wherein the two or more connecting arms each comprise a first upper part connected to the central body and of a second lower part connected to one of the lateral hulls, such that the second part is submerged during navigation, wherein each of the two lateral hulls comprises an elongated body having a substantially cylindrical symmetry, with an annular constriction defined between a fore portion disposed at a first longitudinal end of a lateral hull and an aft portion disposed at a second longitudinal end of the lateral hull, the fore and aft portions having widest cross-sections that taper to define the annular constriction therebetween, wherein the two or more connecting arms or stiffening elements thereof are removable at least from the central body or from corresponding lateral hull, and wherein the watercraft device is of such a size that the two or more connecting arms or stiffening elements thereof are sized to be inserted into one or more ISO 20 or ISO 40 containers after removal.

* * * * *